US009127892B2

(12) United States Patent
Lim et al.

(10) Patent No.: US 9,127,892 B2
(45) Date of Patent: Sep. 8, 2015

(54) EVAPORATOR

(75) Inventors: Hong-Young Lim, Daejeon (KR); Kwang Hun Oh, Daejeon (KR); Young-Ha Jeon, Daejeon (KR)

(73) Assignee: HALLA VISTEON CLIMATE CONTROL CORPORATION, Daejeon (KR)

( * ) Notice: Subject to any disclaimer, the term of this patent is extended or adjusted under 35 U.S.C. 154(b) by 1295 days.

(21) Appl. No.: 12/676,146

(22) PCT Filed: Aug. 27, 2008

(86) PCT No.: PCT/KR2008/005013

§ 371 (c)(1),
(2), (4) Date: Mar. 3, 2010

(87) PCT Pub. No.: WO2009/031782

PCT Pub. Date: Mar. 12, 2009

(65) Prior Publication Data

US 2010/0243223 A1 Sep. 30, 2010

(30) Foreign Application Priority Data

Sep. 3, 2007 (KR) ..... 10-2007-0089014

(51) Int. Cl.
*F28D 1/053* (2006.01)
*F28F 9/22* (2006.01)
(Continued)

(52) U.S. Cl.
CPC ..... *F28D 1/05391* (2013.01); *F25B 39/022* (2013.01); *F28F 9/0204* (2013.01); *F28F 9/028* (2013.01); *F25B 2500/01* (2013.01)

(58) Field of Classification Search
CPC ..... F25B 39/028; F28D 1/05308; F28D 1/05325; F28D 1/05333; F28D 1/05341; F28D 1/05375; F28D 1/05383; F28D 1/05391; F28F 9/0204; F28F 9/0207
USPC ..... 165/153, 174, 176; 62/515
See application file for complete search history.

(56) References Cited

U.S. PATENT DOCUMENTS

2004/0256091 A1 12/2004 Higashiyama
2006/0011335 A1 1/2006 Ohata et al.
(Continued)

FOREIGN PATENT DOCUMENTS

CN 1128344 7/1996
DE 102005062423 7/2006
(Continued)

OTHER PUBLICATIONS

Japanese Office Action for Japanese Application No. 2010-523942.
(Continued)

*Primary Examiner* — Leonard R Leo
(74) *Attorney, Agent, or Firm* — Lowe Hauptman & Ham, LLP

(57) ABSTRACT

The present invention relates to an evaporator, and more particularly, to an evaporator which can restrict a surface area of a communication hole with respect to a cross sectional area of a compartment and a surface area of a tube with respect to a surface area of a fin, thereby providing a dimensional extent for maximizing the heat exchange efficiency. Therefore, by optimizing a relation between the surface area of the communication portion and the surface area of the compartment of the first header tank and dimensions for each surface area and the heights of the tube and fin, the present invention provides a dimensional extent for maximizing the heat radiation amount, reducing the maximum temperature deviation of the core portion and allowing the refrigerant and air to be smoothly flowed, thereby maximizing the heat exchange efficiency.

7 Claims, 14 Drawing Sheets

(51) Int. Cl.
*F25B 39/02* (2006.01)
*F28F 9/02* (2006.01)

(56) References Cited

U.S. PATENT DOCUMENTS

| | | | |
|---|---|---|---|
| 2006/0144577 | A1 | 7/2006 | Higashiyama |
| 2007/0144714 | A1 | 6/2007 | Yabe et al. |
| 2007/0215331 | A1 | 9/2007 | Higashiyama et al. |

FOREIGN PATENT DOCUMENTS

| | | | | |
|---|---|---|---|---|
| DE | 112005000560 | | | 3/2007 |
| EP | 0710811 | | | 5/1996 |
| JP | 08-136176 | | | 5/1996 |
| JP | 2001-324290 | A | | 11/2001 |
| JP | 2001324290 | A | * | 11/2001 |
| JP | 2002-372340 | A | | 12/2002 |
| JP | 2003-130581 | A | | 5/2003 |
| JP | 2004-020104 | A | | 1/2004 |
| JP | 2004-163036 | | | 10/2004 |
| JP | 2005-043041 | | | 2/2005 |
| JP | 2005-043041 | A | | 2/2005 |
| JP | 2005-265356 | A | | 9/2005 |
| JP | 2006-183962 | A | | 7/2006 |
| KR | 1998-0010322 | | | 4/1998 |
| KR | 10-2001-00007153 | A | | 1/2001 |
| KR | 10-2006-0021444 | | | 3/2006 |
| KR | 10-2006-0075848 | | | 7/2006 |
| WO | 03033984 | | | 4/2003 |

OTHER PUBLICATIONS

Examiner's Report issued on Apr. 23, 2012 in Canadian Patent Application No. 2,698,575.
Office Action of corresponding application No. PCT/KR2007/0089014 mailed Oct. 10, 2012.
European Search Report for corresponding European Patent Application No. 08 793 517.7 issued on Nov. 21, 2013.
Office Action for corresponding Japanese Patent Application No. 2012-89624 issued on Mar. 4, 2014.

* cited by examiner (a)

(b)

(a)

(b)

(c)

(a)

(b)

(c)

(a)

(b)

EVAPORATOR

RELATED APPLICATIONS

The present application is based on, and claims priority from, KR Application No. 10-2007-0089014, filed Sep. 3, 2007, and PCT Application No. PCT/KR08/005013, filed Aug. 27, 2008, the disclosures of which are hereby incorporated by reference herein in their entireties.

TECHNICAL FIELD

The present invention relates to an evaporator, and more particularly, to an evaporator which can restrict a surface area of a communication hole with respect to a cross sectional area of a compartment and a surface area of a tube with respect to a surface area of a fin, thereby providing a dimensional extent for maximizing the heat exchange efficiency.

BACKGROUND ART

In the recent automotive industry, according as the global interest in environment and energy is increased, there has been performed research and development in the improvement of fuel efficiency. And, in order to satisfy various users' requirements, there has been also proceeded research and development in light, small and multi-functional automobiles. Also, the evaporator has been improved to realize the smaller size and to increase the heat exchange efficiency together.

The evaporator is a component of an air conditioner in which air introduced by an air blower is cooled due to heat exchange while liquid heat exchange medium is changed into a gaseous state and then the cooled air is supplied inside a vehicle.

A conventional evaporator includes first and second header tanks which forms at least one or more compartments and disposed to be parallel with each other; inlet and outlet pipes which are formed at one side of the first header tank; a baffle which is provided in the first or second header tank to control a flow of refrigerant; a core portion having a plurality of tubes of which both ends are fixedly disposed at the first and second header tanks to form a first row communicated with the inlet pipe and a second row communicated with the outlet pipe, and a plurality of fins which are interposed between the tubes; and a communication portion which has a communicating hole for communicating a part of the first and second rows.

Since the evaporator is comprised of the first and second rows, even though a flow passage of the header tank and the tube is formed properly, the flow of refrigerant is considerably changed according to a size of the communicating hole of the communication portion for communicating the first and second rows.

Further, in the evaporator, the refrigerant is flowed through the header tank and the tube, and while external air is flowed along the fin interposed between the tubes, the heat exchange is occurred between the refrigerant and the external air. Thus, if a height of the tube is high, the internal refrigerant is smoothly flowed, but since a height of the external fin is reduced and thus the flow of external air is restricted, the heat exchange performance is deteriorated. However, if the height of the tube is low, the external air can be smoothly flowed, but the flow of internal refrigerant is restricted and thus the heat exchange performance is deteriorated.

A surface temperature of the evaporator is changed according to the size and surface area of the communicating hole, and the height of the fin and tube, and temperature deviation on a surface of the core portion may be occurred.

However, in the conventional evaporator, there was provided only limitation of its shape or general dimensions, and there was never provided a detailed dimensional extent such as the surface area of the communicating hole and the number of the communicating holes considering the flow of refrigerant, and the height and the surface area of the fin and tube and a density of the fins considering a pressure drop amount of the refrigerant and the like.

DISCLOSURE

Technical Problem

An object of the present invention is to provide an evaporator with a core portion having a width of 20~35 mm, which has a dimensional extent such as the surface area of the communicating hole, the number of the communicating holes, the height of the tube, a density of the fins and like considering the flow of refrigerant so as to minimize a difference in the surface temperature and maximize a heat radiation amount in the evaporator, thereby increasing the heat exchange efficiency.

Technical Solution

To achieve the object of the present invention, the present invention provides an evaporator 80 comprising first and second header tanks 10 and 20 which form at least one or more compartments 11 and disposed parallely to be apart from each other in a distance; inlet and outlet pipes 30 and 40 which are respectively formed at one side of the first header tank 10; a baffle 50 which is provided in the first or second header tank 10 or 20 so as to control a flow of refrigerant and; a core portion 60 having a plurality of tubes 61 of which both ends are fixedly disposed at the first and second header tanks 10 and 20 to form a first row communicating with the inlet pipe 30 and a second row communicating with the outlet pipe 40, and a plurality of fins 62 which are interposed between the tubes 61, wherein the core portion 60 has a width $W_{core}$ of 20~35 mm, and a communication portion 70 having a communicating hole 71 for communicating parts of the first and second rows is formed in the first header tank 10 or the second header tank 20, and a surface area A71 of the communicating hole 71 is formed to be 70~130% of a cross sectional area A11' of the compartment 11 of the first header tank 10 or the second header tank 20 communicating with the first row.

Preferably, the communication portion 70 has one communicating hole 71, the fin 62 has a height $H_{fin}$ of 4~7 mm, and the tube 61 has a height $H_{tube}$ of 2~3 mm.

Further, the present invention provides an evaporator 80 comprising first and second header tanks 10 and 20 which form at least one or more compartments 11 and disposed parallely to be apart from each other in a distance; inlet and outlet pipes 30 and 40 which are respectively formed at one side of the first header tank 10; a baffle 50 which is provided in the first or second header tank 10 or 20 so as to control a flow of refrigerant and; a core portion 60 having a plurality of tubes 61 of which both ends are fixedly disposed at the first and second header tanks 10 and 20 to form a first row communicating with the inlet pipe 30 and a second row communicating with the outlet pipe 40, and a plurality of fins 62 which are interposed between the tubes 61, wherein the core portion 60 has a width $W_{core}$ of 20~35 mm, and a surface area A61 of the tube 61 in the core portion 60 is formed to be 30~50% of a surface area A62 of the fin 62, and a communication portion 70 having a communicating hole 71 for communicating parts of the first and second rows is formed in the first header tank 10 or the second header tank 20.

Preferably, a surface area A71 of the communicating hole 71 is formed to be 70~130% of a cross sectional area A11' of the compartment 11 of the first header tank 10 or the second header tank 20 communicating with the first row, and a density $D_{fin}$ of the fins 62 is 60~78 FPDM (Fin Per Deci-Meter).

Further, the surface area A71 of the communicating hole is formed to be 5~30% of a surface area A70 of the communication portion 70.

Preferably, the evaporator 80 comprises a first region A1 in which the refrigerant introduced to the first header tank 10 via the inlet pipe 30 is flowed to the second header tank 20 through the tube 61 of the first row, a second region A2 which is adjacent to the first region A1 and in which the refrigerant flowed to the second header tank 20 through the first region A1 is flowed to the first header tank 10 through the tube 61 of the first row, a third region A3 in which the refrigerant flowed through the communication portion 70 of the first header tank 10 is flowed to the second header tank 20 through the tube 61 of the second row, and a fourth region A4 in which the refrigerant flowed to the second header tank 20 through the third region A3 is flowed to the first header tank 10 through the tube 61 of the second row, and the refrigerant is discharged through the outlet pipe 40.

Preferably, the evaporator 80 comprises a first region A1 in which the refrigerant introduced to the first header tank 10 via the inlet pipe 30 is flowed to the second header tank 20 through the tube 61 of the first row, a second region A2 which is adjacent to the first region A1 and in which the refrigerant flowed to the second header tank 20 through the first region A1 is flowed to the first header tank 10 through the tube 61 of the first row, a third region A3 which is adjacent to the second region A2 and in which the refrigerant flowed to the first header tank 10 through the second region A2 is flowed to the second header tank 20 through the tube 61 of the first row, and a fourth region A4 in which the refrigerant flowed through communication portion 70 of the second header tank 20 is flowed to the first header tank 10 through the tube 61 of the second row, a fifth region A5 which is adjacent to the fourth region A4 and in which the refrigerant flowed to the first header tank 10 through the fourth region A4 is flowed to the second header tank 20 through the tube 61 of the second row, and a sixth region A6 which is adjacent to the fifth region A5 and in which the refrigerant flowed to the second header tank 20 through the fifth region A5 is flowed to the first header tank 10 through the tube 61 of the second row, and the refrigerant is discharged through the outlet pipe 40.

ADVANTAGEOUS EFFECTS

Therefore, by optimizing a relation between the surface area of the communication portion and the surface area of the compartment of the first header tank and dimensions for each surface area and the heights of the tube and fin, the present invention provides a dimensional extent for maximizing the heat radiation amount, reducing the maximum temperature deviation of the core portion and allowing the refrigerant and air to be smoothly flowed, thereby maximizing the heat exchange efficiency.

DESCRIPTION OF DRAWINGS

The above and other objects, features and advantages of the present invention will become apparent from the following description of preferred embodiments given in conjunction with the accompanying drawings, in which.

DETAILED DESCRIPTION OF MAIN ELEMENTS

Figure 1:
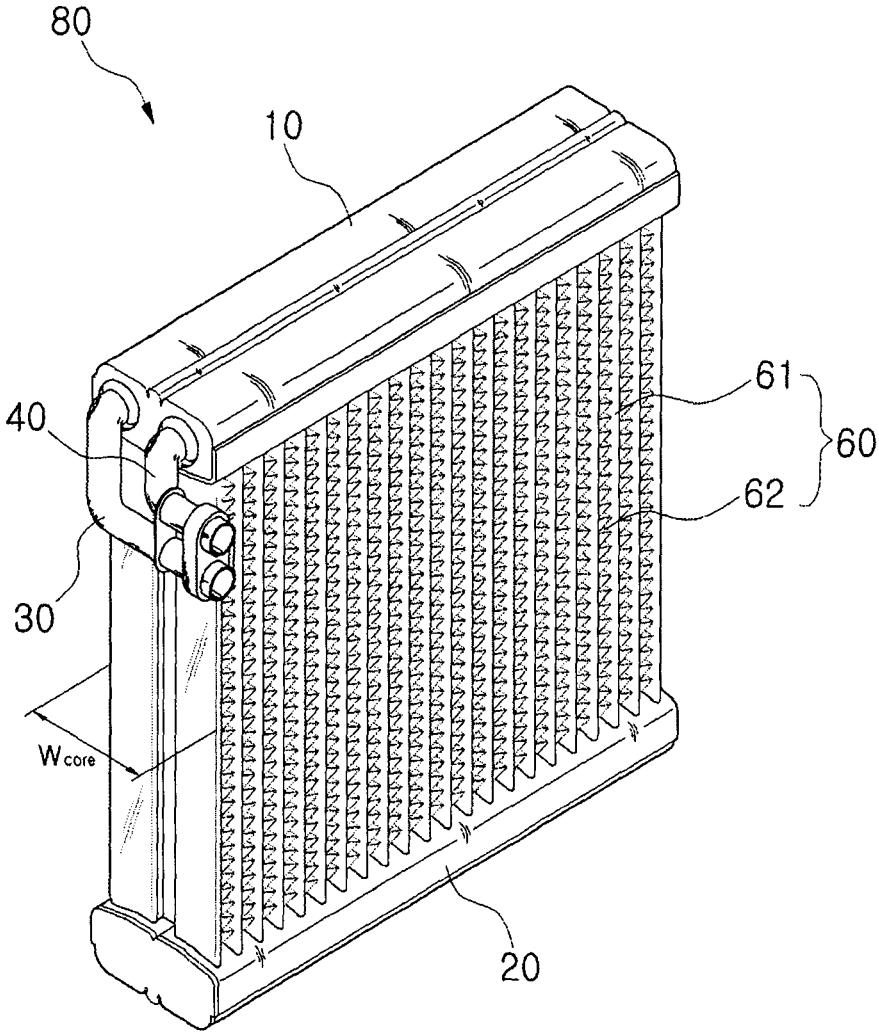
FIG. 1 is a perspective view of an evaporator according to the present invention.

10: first header tank
11: compartment
20: second header tank
30: inlet pipe
40: outlet pipe
50: baffle
60: core portion
61: tube
62: fin
70: communication portion
71: communicating hole
80: evaporator of the present invention
A1~A4: each region of evaporator
A70: surface area of communication portion
A71: surface area of communicating hole
A60: surface area of core portion
A61: surface area of tube A62: surface area of fin A11': cross sectional area of compartment communicated with first row of first header tank $W_{core}$; width of core portion $H_{fin}$: height of fin $H_{tube}$: height of tube $D_{fin}$: density of fins

[Best Mode]

Hereinafter, the embodiments of the present invention will be described in detail with reference to accompanying drawings.

FIG. 1 is a perspective view of an evaporator 80 according to the present invention. The evaporator 80 of the present invention includes first and second header tanks 10 and 20 which form at least one or more compartments 11 and disposed parallely to be apart from each other in a distance; a core portion 60 having a plurality of tubes 61 of which both ends are fixedly disposed at the first and second header tanks 10 and 20 to form a first row and a second row, and a plurality of fins 62 which are interposed between the tubes 61; and inlet and outlet pipes 30 and 40 which are respectively formed at one side of the first header tank 10 or the second head tank 20.

Further, a baffle 50 for controlling a flow of refrigerant and a communication portion 70 having a communicating hole 71 for communicating the first and second rows are provided in the first or second header tank 10 or 20. The core portion 60 has a width $W_{core}$ of 20~35 mm.

The width $W_{core}$ of the core portion 60 is a side surface of the tube 61 and the fin 62 and means a width of an effective surface area in which the heat exchange medium is flowed, as shown in FIG. 1.

As shown in FIG. 1, the present invention may be formed to have a 4-pass flow, and is characterized by a dimensional extent for improving the heat exchange efficiency, such as a surface area A71 of the communicating hole 71, a surface area A62 of the fin 62, a surface area A61 of the tube 61, a density $D_{fin}$ of the fins 62 and the like, when the width $W_{core}$ of the core portion 60 is 20~35 mm. First of all, the refrigerant flow in the evaporator 80 and the technical terms used in the present invention will be described.

Figure 17:
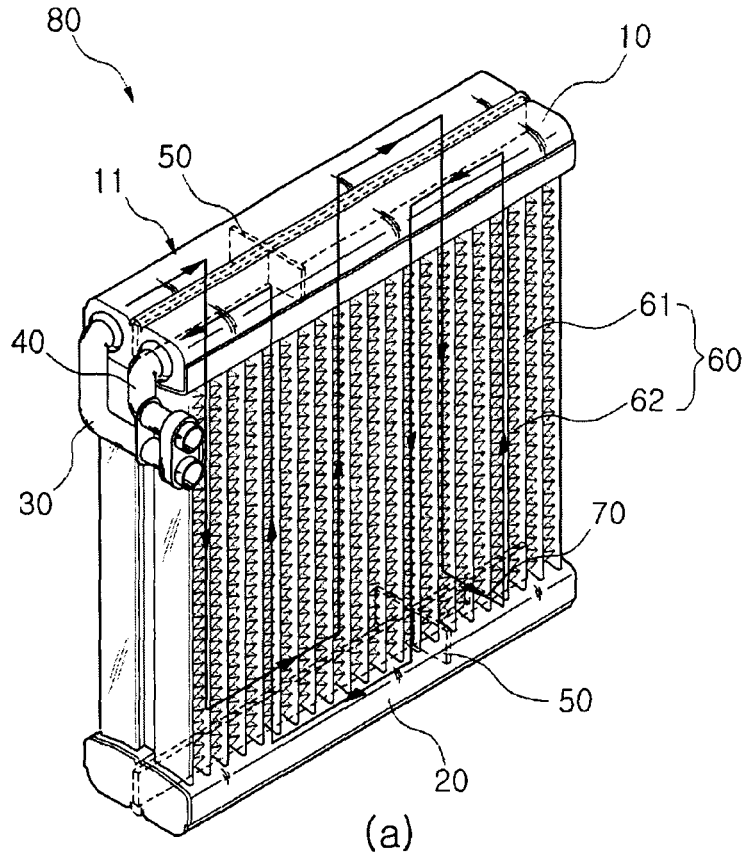
FIG. 17 is a view of another evaporator according to the present invention.
Figure 17:
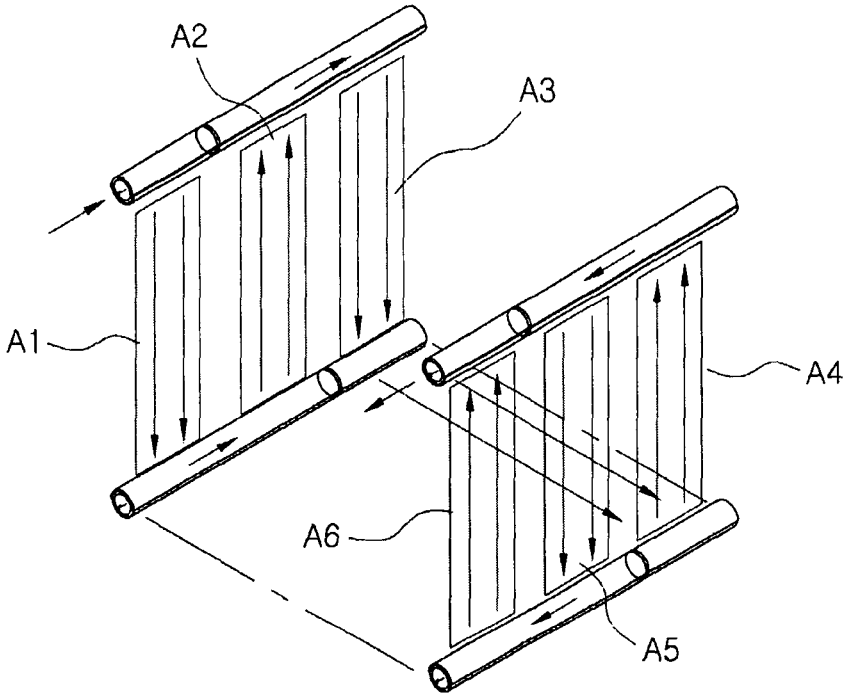

Furthermore, as shown in FIG. 17, the evaporator 80 of the present invention may be formed to have a 6-pass flow which will be described later.

Figure 2:
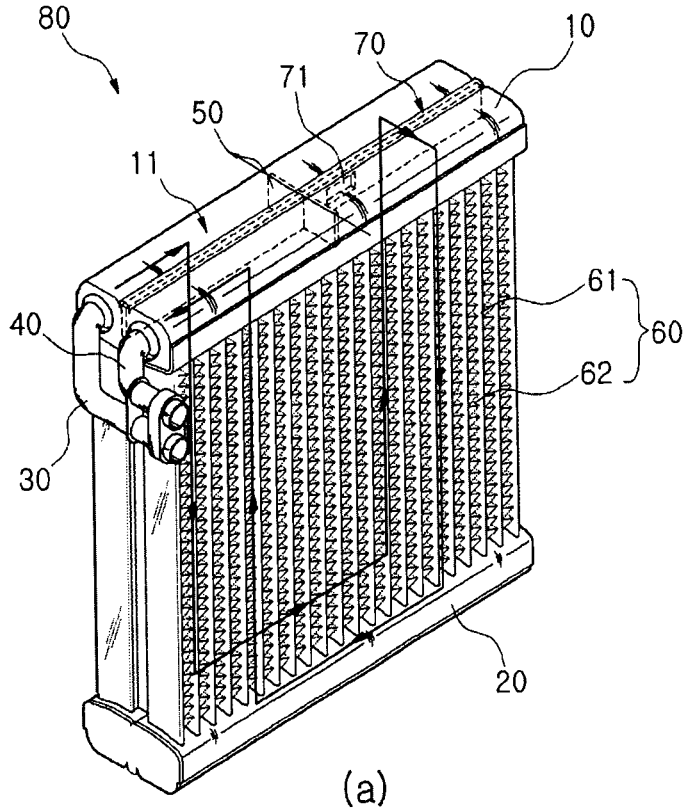
FIG. 2 is a schematic view showing a flow of refrigerant in the evaporator of FIG. 1.
Figure 2:
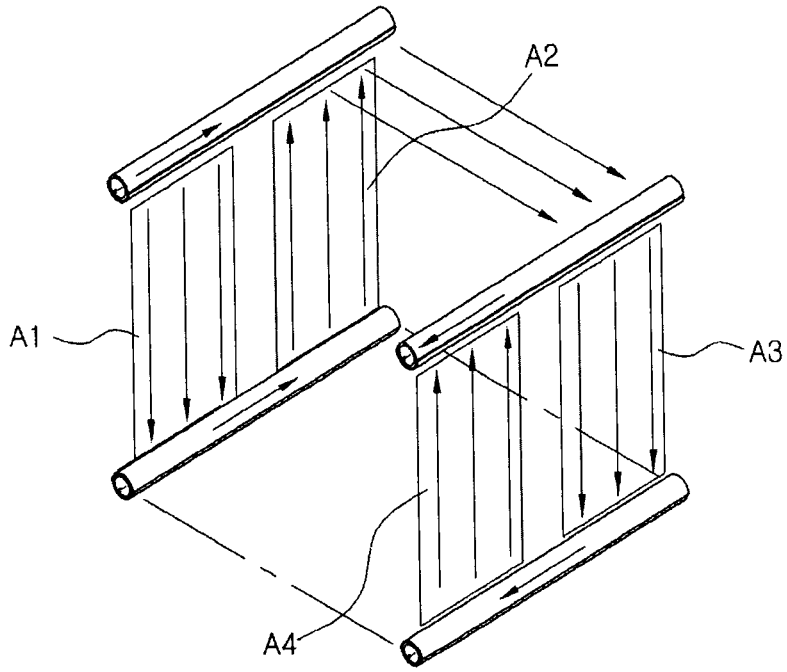

FIG. 2 is a schematic view showing a flow of refrigerant in the evaporator 80 of FIG. 1. The evaporator 80 of the present invention is formed with a first region A1 and a second region A2 which are adjacent to each other and communicated with the first row and a third region A3 and a fourth region A4 which are adjacent to each other and communicated with the second row.

In more detail, the evaporator 80 of the present invention includes the first region A1 in which the refrigerant introduced to the first header tank 10 via the inlet pipe 30 is flowed to the second header tank 20 through the tube 61 of the first row, the second region A2 which is adjacent to the first region A1 and in which the refrigerant flowed to the second header tank 20 through the first region A1 is flowed to the first header tank 10 through the tube 61 of the first row, the third region A3 in which the refrigerant flowed through the communication portion 70 of the first header tank 10 is flowed to the second header tank 20 through the tube 61 of the second row, and the fourth region A4 in which the refrigerant flowed to the second header tank 20 through the third region A3 is flowed to the first header tank 10 through the tube 61 of the second row. The refrigerant is discharged to the outlet pipe 40 through the fourth region A4 adjacent to the third region A3.

Figure 3:
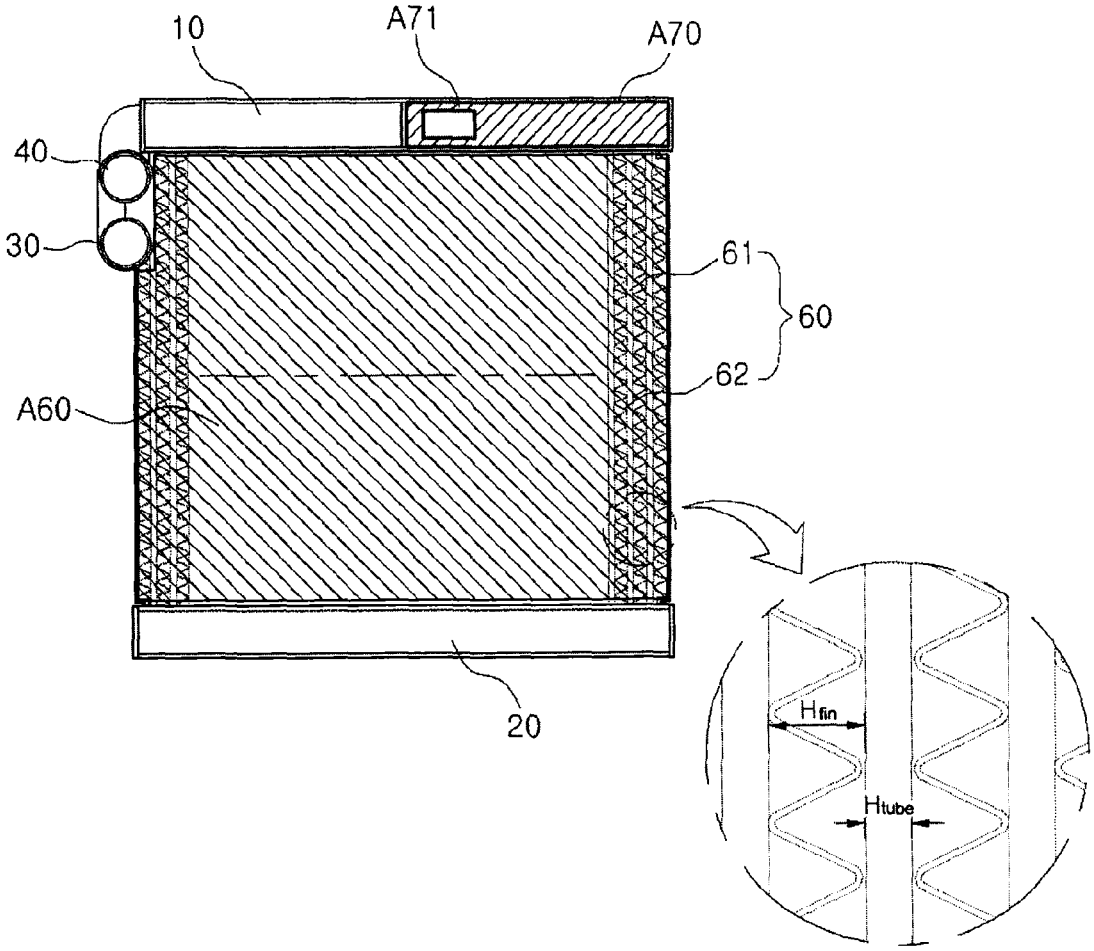
FIG. 3 is a cross-sectional view of the evaporator of FIG. 1.

FIG. 3 is a cross-sectional view of the evaporator 80 of FIG. 1. The communication portion 70 is served as a portion for connecting the second and third regions A2 and A3. The surface area A70 of the communication portion 70 is an entire surface area of a portion in which the communicating hole 71 can be formed, as shown in FIG. 3. The surface area A71 of the communicating hole 71 is a surface area of a hole formed at the communication portion 70.

Figure 4:
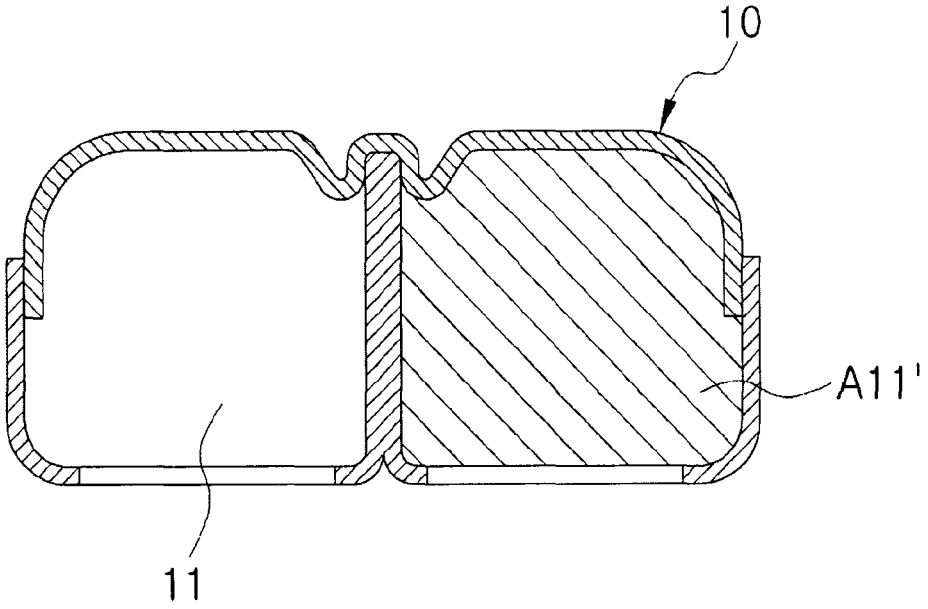
FIG. 4 is a cross-sectional view of a header tank of the evaporator of FIG. 1.

And, as shown in FIG. 3, the surface area A60 of the core portion 60 is an entire portion in which the tube 61 and the fin 62 are formed. FIG. 4 is a cross-sectional view of a header tank of the evaporator 80 of FIG. 1, wherein a portion designated by oblique lines is a surface area A11' of a compartment 11 communicated with the first row of the first header tank 10.

Figure 5:
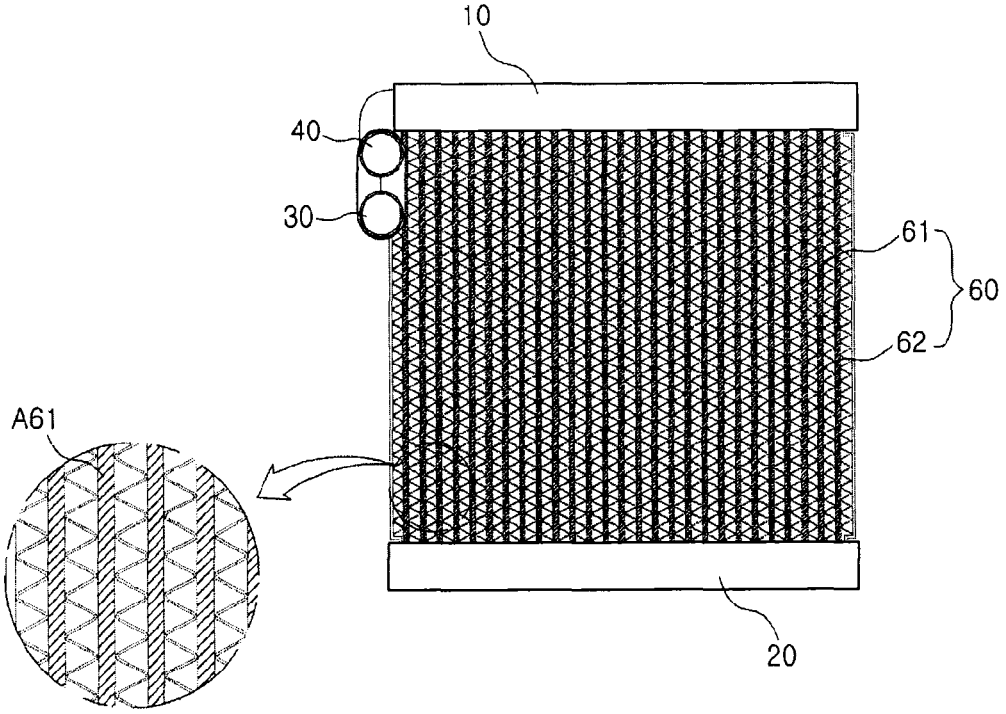
FIG. 5 is a front view of the evaporator of FIG. 1, which shows a surface area of a tube.
Figure 6:
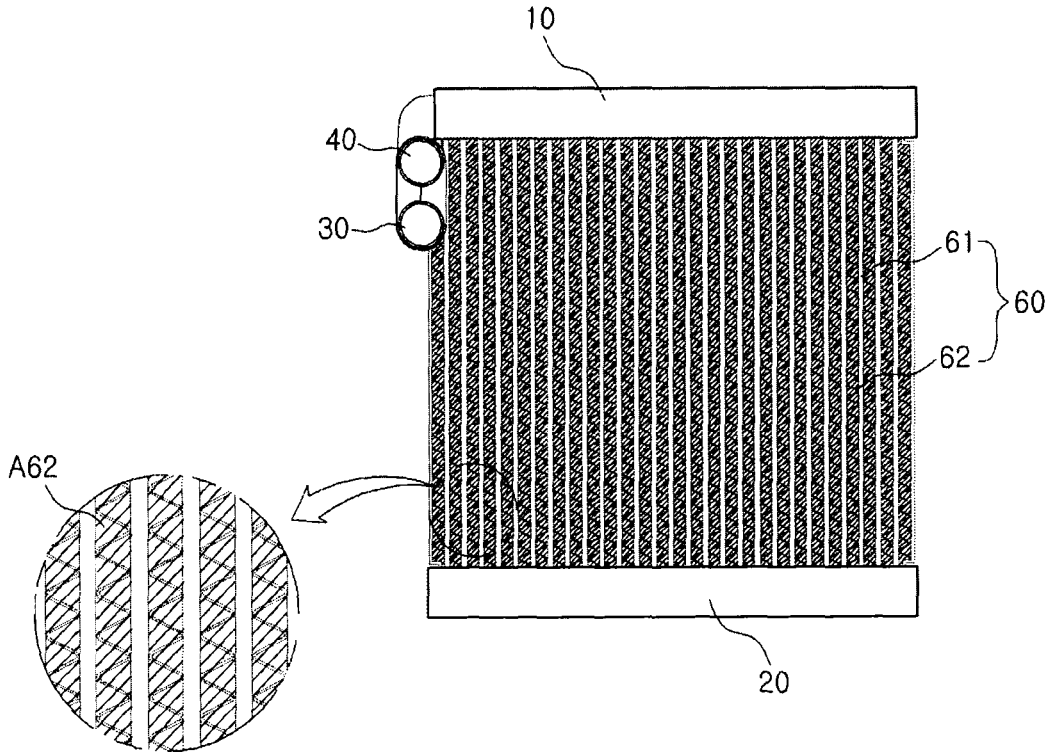
FIG. 6 is a front view of the evaporator of FIG. 1, which shows a surface area of a fin.

FIGS. 5 and 6 are front views of the evaporator 80 of FIG. 1, which show surface areas A61 and A62 of the tube 61 and the fin 62, respectively.

As shown in FIG. 5, the surface area A61 of the tube 61 is a portion in which the tube 61 is formed when 5 viewing the evaporator 80, and as shown in FIG. 6, the surface area A62 of the fin 62 is a portion in which the fin 62 is formed when squarely viewing the evaporator 80.

The evaporator 80 of the present invention is constructed as shown in FIGS. 1 and 4. The width $W_{core}$ of the core portion 60 is 20~35 mm, and the surface area A71 of the communicating hole 71 is 700~130% of the cross-sectional area A11' of the compartment 11 of the first header tank 10 communicated with the first row.

Figure 7:
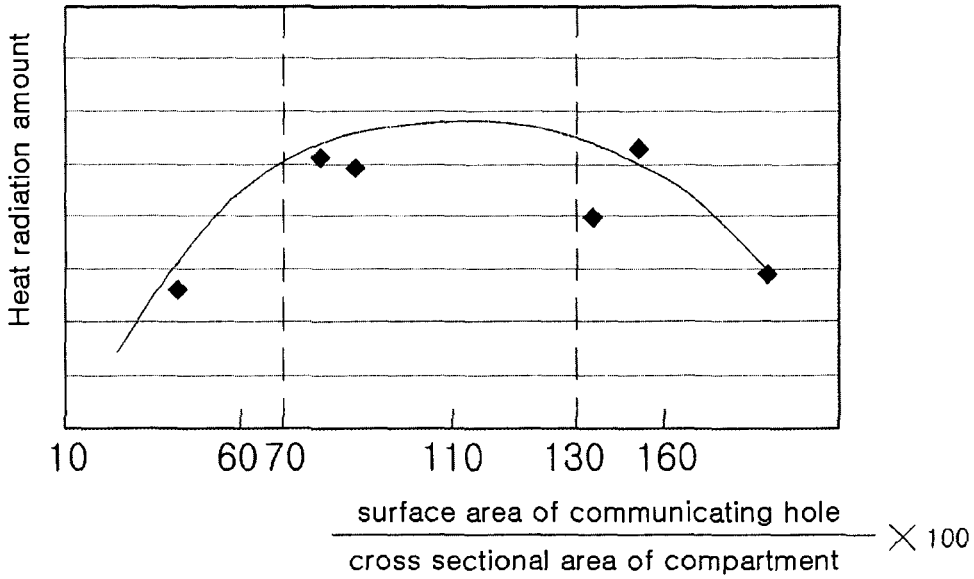
FIG. 7 is a view showing a heat radiation amount according to a surface area of a communication hole/a cross-sectional area of a compartment.
Figure 8:
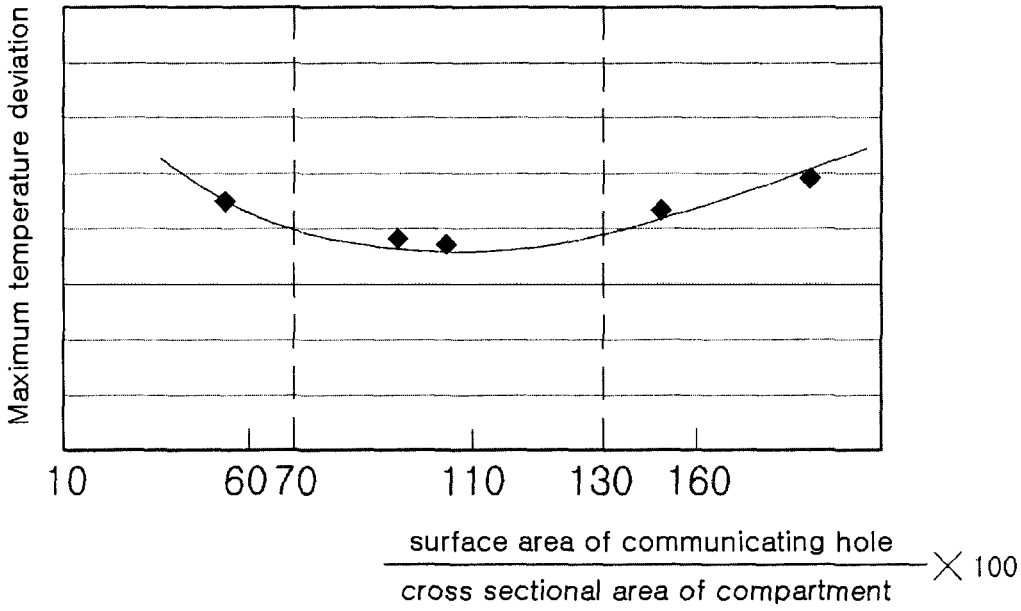
FIG. 8 is a view showing a maximum temperature deviation on a surface of a core portion according to the surface area of the communication hole/the cross-sectional area of the compartment.

FIG. 7 is a view showing a heat radiation amount according to the surface area A71 of the communication hole/the cross-sectional area A11' of the compartment, and FIG. 8 is a view showing a maximum temperature deviation on the surface of the core portion 60 according to the surface area A71 of the communication hole/the cross-sectional area A11' of the compartment, which show results in a status that, in the evaporator of 270~280 mm wide×265 mm long×35 mm thick, the surface area A71 of the communicating hole 71 is varied, while the cross-sectional area A11' of the compartment 11 communicated with the first row of the first header tank 10 is fixedly formed.

As shown in FIGS. 7 and 8, when the surface area A71 of the communicating hole 71 with respect to the cross-sectional area A11' of the compartment 11 is 70~130%, the heat radiation amount of the evaporator 80 becomes maximum, and the maximum temperature deviation on the surface of evaporator 80 becomes minimum.

In case that the heat radiation amount is low, since the heat exchange efficiency of the evaporator 80 is deteriorated, the stable air-conditioning performance cannot be expected. And as the maximum temperature deviation on the surface of evaporator 80 is increased, the temperature of the air passing through each part becomes different, and it is difficult to provide pleasant temperature to persons in a vehicle. Therefore, in order to increase the heat radiation amount and decrease the maximum temperature deviation, the evaporator 80 of the present invention is constructed so that the surface area A71 of the communicating hole 71 is 70~130% of the cross sectional area A11' of the compartment 11 of the first header tank 10 communicated with the first row.

Figure 9:
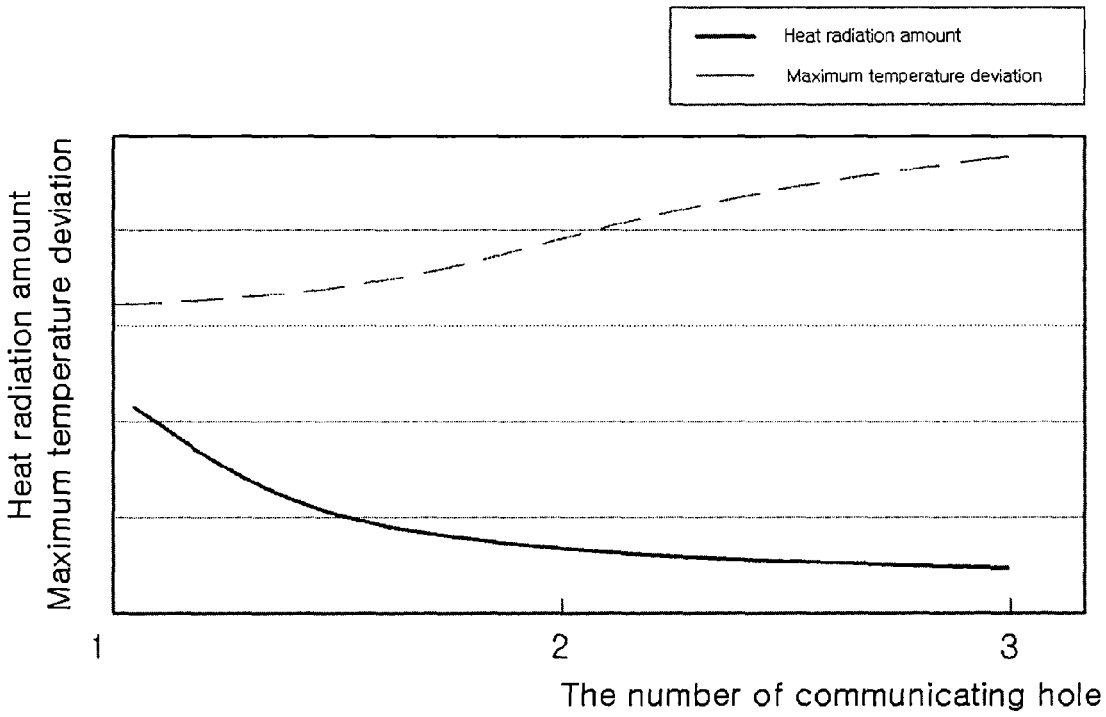
FIG. 9 is a view showing a heat radiation and a maximum temperature deviation on the surface of the core portion according to the number of communicating holes.

FIG. 9 is a view showing the heat radiation and the maximum temperature deviation on the surface of the core portion 60 according to the number of communicating holes 71, which show a result in case that the number of the communicating holes 71 is changed from 1 to 3 while the entire surface area A71 of the communicating hole 71 is fixedly formed.

As shown in FIG. 9, in case that the number of the communicating holes 71 is changed without the variation of the surface area A71 of the communicating hole 71, the heat radiation is lowered and the maximum temperature deviation is increased according as the number of the communicating holes is increased. Therefore, in the evaporator 80 of the present invention, the communication portion 70 has to have one communicating hole 71.

If the number of the communicating holes 71 is increased, the surface area A71 of each communicating hole 71 is reduced and a distance between the communicating holes 71 is formed, and thus it exerts a bad effect on refrigerant distribution according to the variation of the number of tubes 61 and the like exerting an effect on the communicating hole 71.

Figure 10:
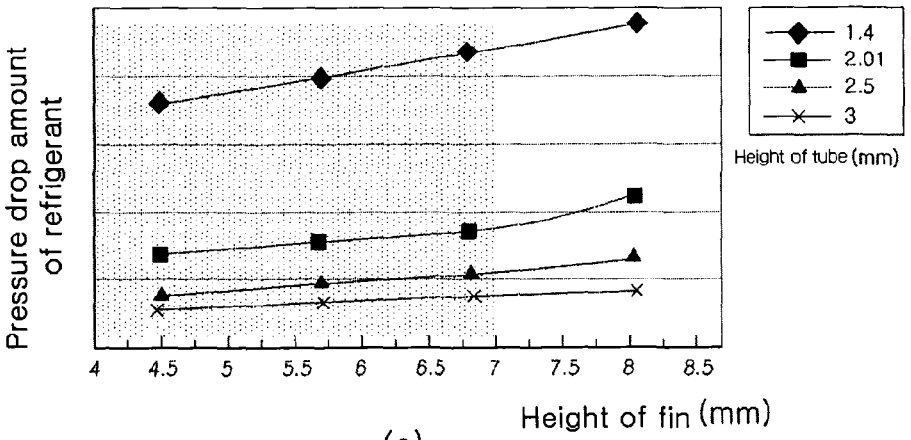
FIG. 10 is a view showing a pressure drop amount of refrigerant, a pressure drop amount of air and a heat radiation amount according to a height of the fin.
Figure 10:
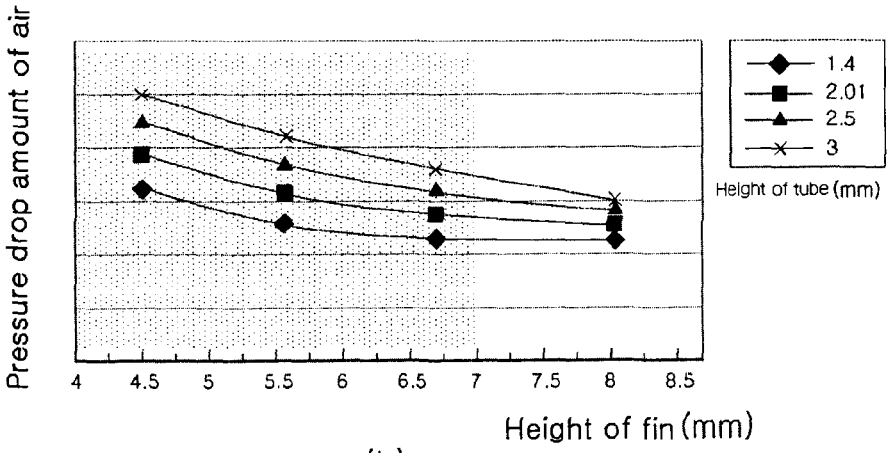
Figure 10:
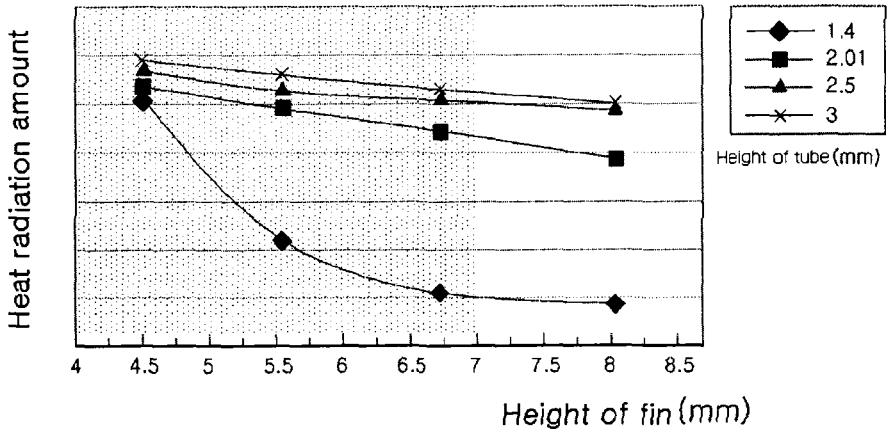

FIG. 10 is a view showing a pressure drop amount of refrigerant, a pressure drop amount of air and the heat radiation amount according to a height $H_{fin}$ of the fin 62, wherein (a) shows the pressure drop amount of refrigerant, (b) is the pressure drop amount of air and (c) is the heat radiation amount when the height $H_{fin}$ of the fin 62 is changed according to the height $H_{tube}$ of each tube 61.

As shown in FIG. 10, when the height $H_{fin}$ of the fin 62 is 4~7 mm, it shows that the pressure drop amount of refrigerant and the pressure drop amount of air are proper and the heat radiation amount is high.

Figure 11:
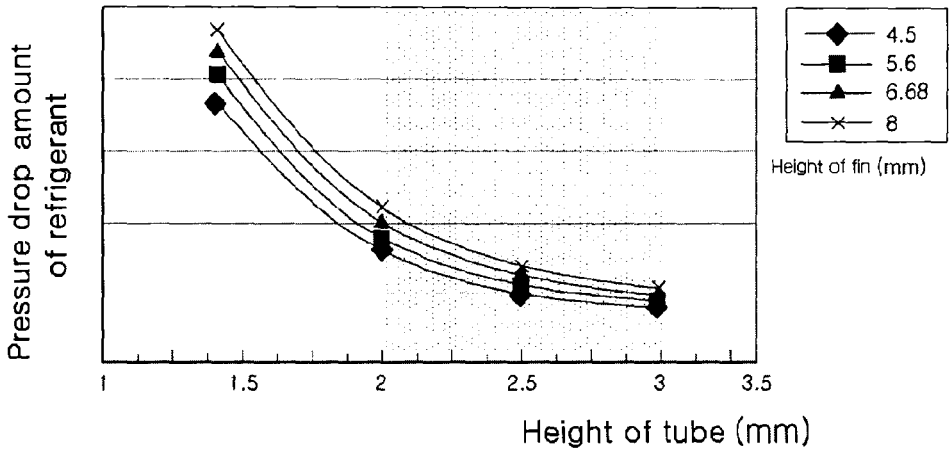
FIG. 11 is a view showing a pressure drop amount of refrigerant, a pressure drop amount of air and a heat radiation amount according to a height of the tube.
Figure 11:
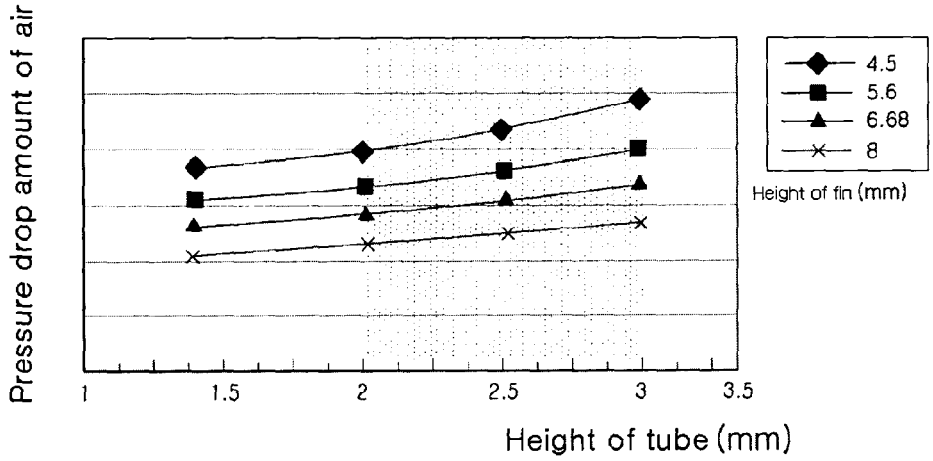
Figure 11:
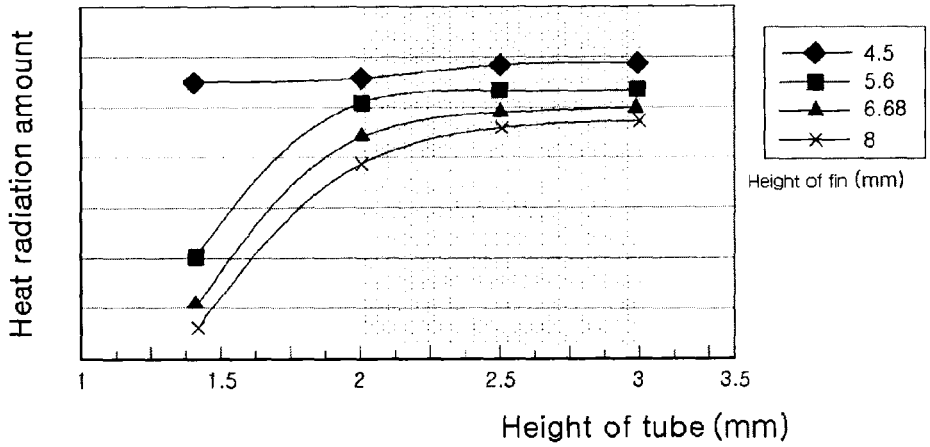

And FIG. 11 is a view showing the pressure drop amount of refrigerant, the pressure drop amount of air and the heat radiation amount according to the height $H_{tube}$ of the tube 61, wherein (a) shows the pressure drop amount of refrigerant, (b) is the pressure drop amount of air and (c) is the heat radiation amount when the height $H_{tube}$ of the tube 61 is changed according to the height $H_{fin}$ of each fin 62.

As shown in FIG. 11, when the height $H_{tube}$ of the tube 61 is 2~3 mm, it shows that the pressure drop amount of refrigerant and the pressure drop amount of air are proper and the heat radiation amount is high.

As shown in FIGS. 10 and 11, it is preferable in the evaporator 80 of the present invention that the height $H_{fin}$ of the fin 62 is 4~7 mm and the height $H_{tube}$ of the tube 61 is 2~3 mm.

Meanwhile, another evaporator 80 of the present invention formed as shown in FIGS. 1 to 4 is characterized in that the width $W_{core}$ of the core portion 60 is 20~35 mm, and the surface area A61 of the tube 61 in the core portion 60 is 30~50% of the surface area A62 of the fin 62.

Since the tube 61 and the fin 62 respectively form flow passages of the refrigerant and air, the surface area A61 of the tube 61 and the surface area A62 of the fin 62 have a great influence on the flow of refrigerant and air. In more detail, if the surface area A61 of the tube 61 is increased, the refrigerant in the tube 61 is smoothly flowed, but since the pressure drop amount of air is excessively increased, the heat radiation amount is reduced, and if the surface area A62 of the fin 62 is increased, the flowing air is smoothly flowed, but since the space in the tube 61 is reduced and thus the pressure drop amount of refrigerant is excessively increased, the heat radiation amount is reduced.

In general, since the entire size of the evaporator 80 is previously determined, the evaporator 80 of the present invention properly adjusts the surface areas of the tube 61 and the fin 62 and thus provides a dimension of the surface area A61 of the tube 61 with respect to the surface area A62 of the fin 62 so as to maximize the heat radiation amount.

Figure 12:
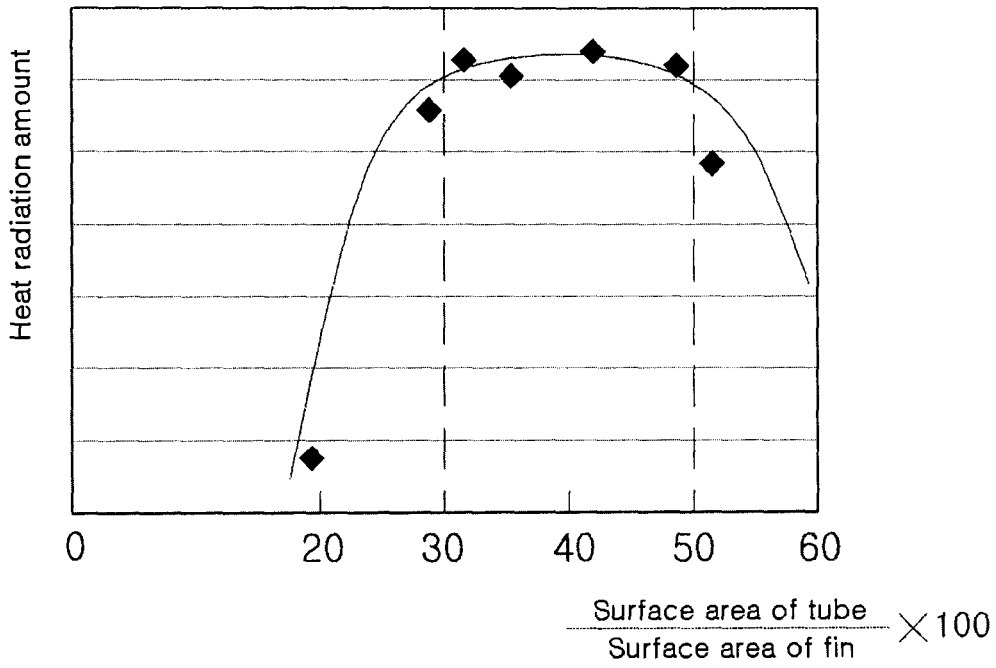
FIG. 12 is a view showing a heat radiation amount according to a surface area of the tube/a surface area of the fin.
Figure 13:
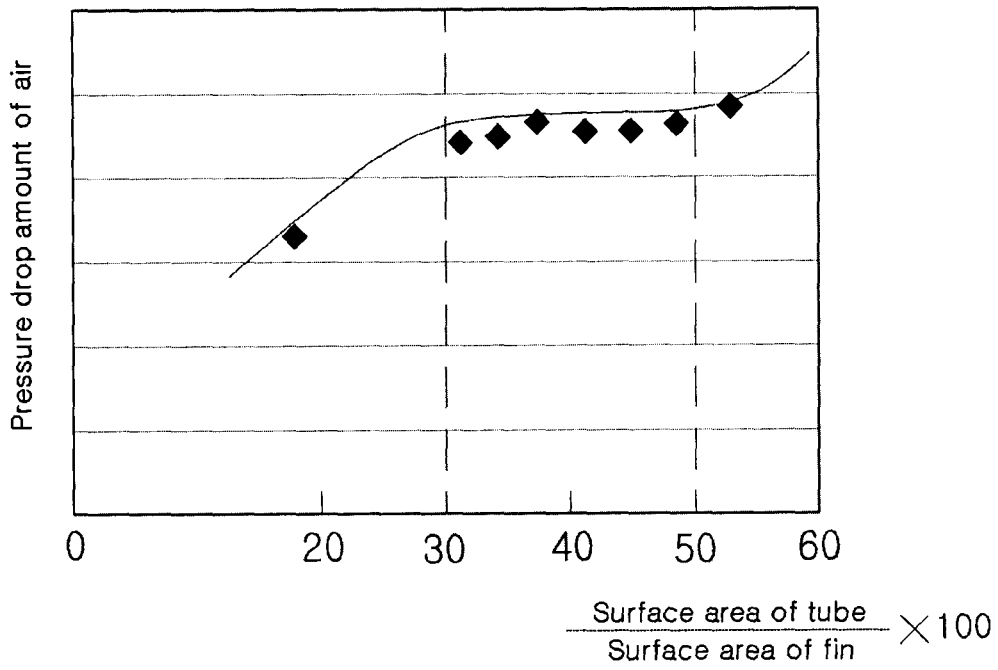
FIG. 13 is a view showing a pressure drop amount of air according to the surface area of the tube/the surface area of the fin.

FIG. 12 is a view showing the heat radiation amount according to the surface area A61 of the tube 61/the surface area A62 of the fin 62 and FIG. 13 is a view showing the pressure drop amount of air according to the surface area A61 of the tube 61/the surface area A62 of the fin 62. In FIGS. 12 and 13, it can be understood that the heat radiation amount is maximum and the pressure drop amount of air is properly maintained, when the surface area A61 of the tube 61 is 30~50% of the surface area A62 of the fin 62.

Further, it is preferable in the evaporator 80 that the surface area A71 of the communicating hole 71 is formed to be 70~130% of the cross sectional area A11' of the compartment 11 of the first header tank 10 communicated with the first row and the density $D_{fin}$ of the fins 62 is 60~78 FPDM (Fin Per Deci-Meter) so as to increase the heat radiation amount according to an amount of the applied refrigerant.

Figure 16:
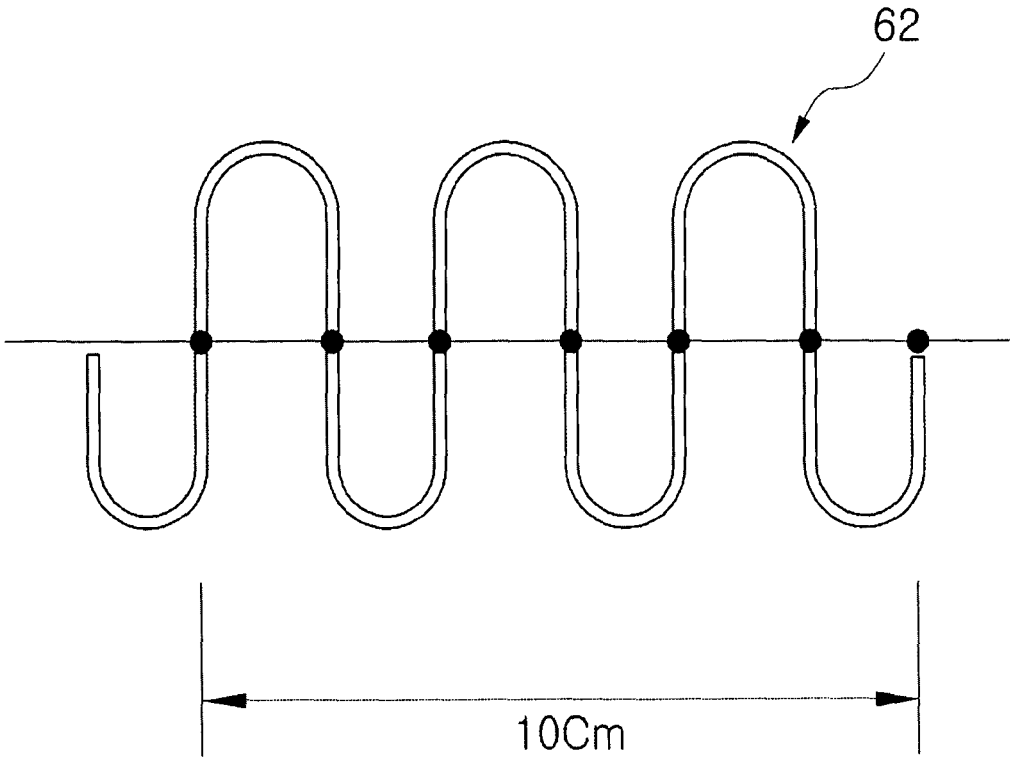
FIG. 16 is a view explaining FPDM.

Herein, the FPDM means the number of fins per 10 Cm. FIG. 16 is a view for explaining the FPDM, wherein the density $D_{fin}$ of the fins 62 is 7FPDM.

The proper flowing of air is influenced by the number of the fins 62 formed on the surface area A62 of the fin 62 as well as the entire surface area that the fins 62 are formed. Therefore, in the evaporator 80 of the present invention, the density $D_{fin}$ of the fins 62 is 60~78FPDM, that is, 60~78 fins are provided per 10 Cm.

In the evaporator 80, it is preferable that the surface area A71 of the communicating hole 71 is formed to be 5~30% of the surface area A70 of the communication portion 70

Figure 14:
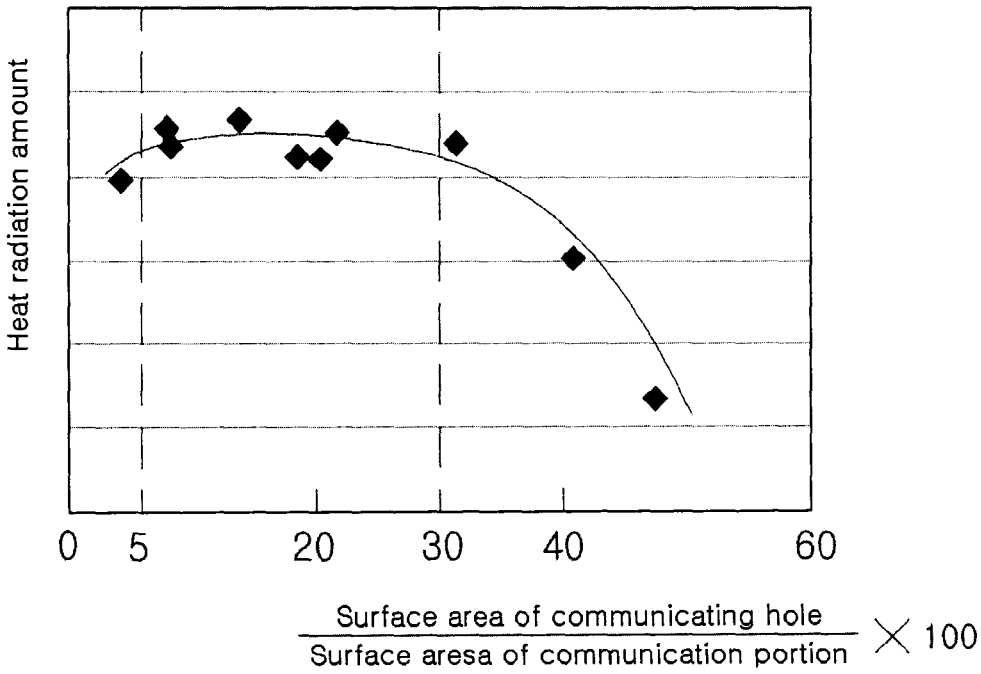
FIG. 14 is a view showing a heat radiation amount according to a surface area of the communicating hole/a surface area of the communication portion.
Figure 15:
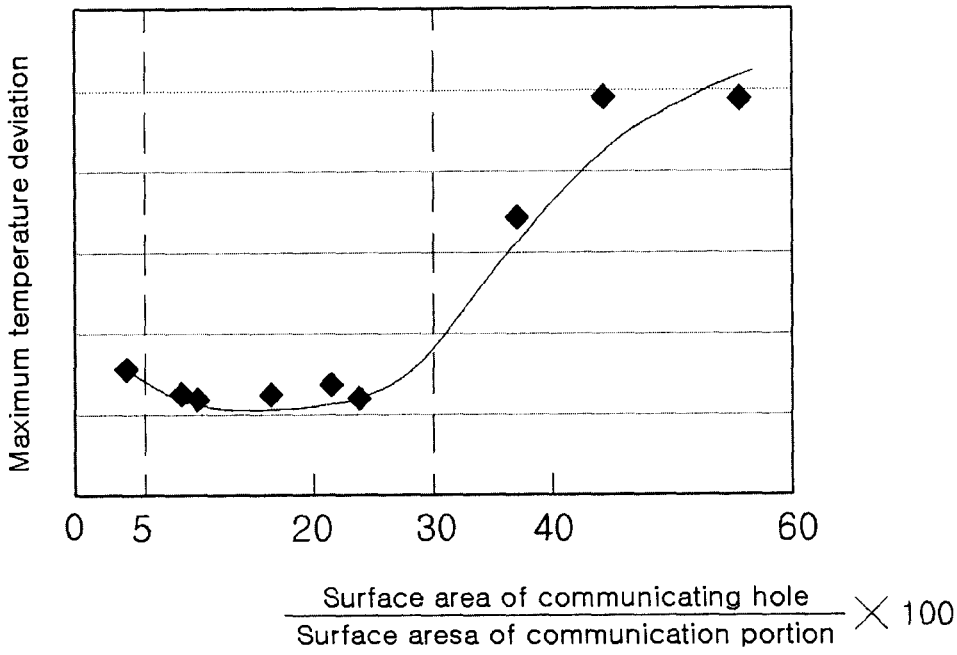
FIG. 15 is a view showing a maximum temperature deviation on the surface of the core portion according to the surface area of the communicating hole/the surface area of the communication portion.

FIG. 14 is a view showing the heat radiation amount according to the surface area A71 of the communicating hole 71/the surface area A70 of the communication portion 70, and FIG. 15 is a view showing the maximum temperature deviation on the surface of the core portion 60 according to the surface area A71 of the communicating hole 71/the surface area A70 of the communication portion 70, which respectively show the heat radiation amount and the maximum temperature deviation on the surface of the core portion 60 when the surface area A71 of the communicating hole 71 is changed while the entire surface area of the communication portion 70 is set to 0.0018081 $m^2$ and the rest conditions are the same.

Referring to FIG. 14, in case that the surface area A71 of the communicating hole 71/the surface area A70 of the communication portion 70 is over 40%, the heat radiation amount is sharply reduced, and in case that the surface area A71 of the communicating hole 71/the surface area A70 of the communication portion 70 is over 30%, the maximum temperature deviation on the surface of the core portion 60 is rapidly increased. Therefore, in order to prevent the reduction of the heat radiation amount and reduce the maximum temperature deviation, the surface area A71 of the communicating hole 71 with respect to the surface area A70 of the communication portion 70 is formed to be 30% in the evaporator 80 of the present invention.

As described above, the evaporator 80 of the present invention provides a dimensional extent for maximizing the heat radiation amount, reducing the maximum temperature deviation of the core portion 60 and allowing the refrigerant and air to be smoothly flowed, thereby maximizing the heat exchange efficiency.

Figure 18:
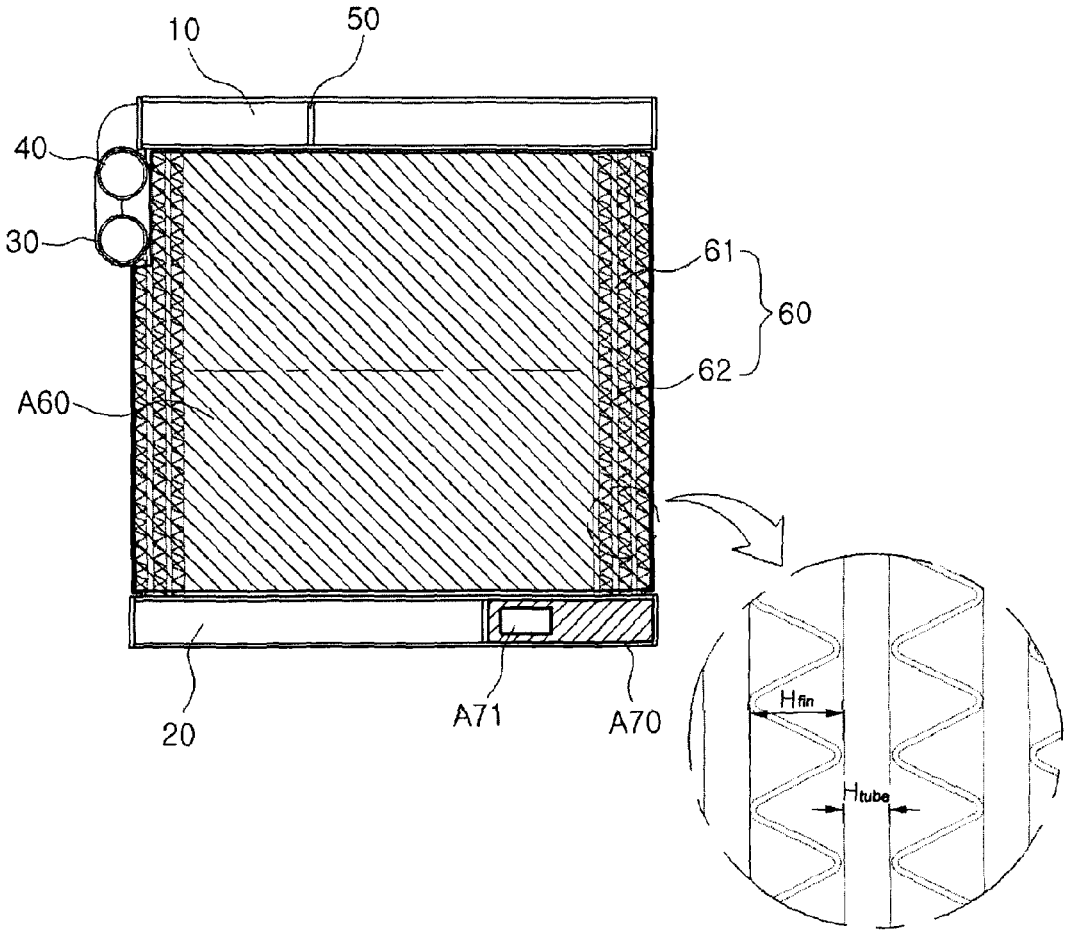
FIG. 18 is a cross-sectional view of the evaporator of FIG. 17.

In addition, as shown in FIGS. 17 and 18, the evaporator 80 of the present invention may be formed to have a 6-pass flow to be described below. The evaporator 80 of the present invention shown in FIG. 17 includes a first region A1 in which the refrigerant introduced to the first header tank 10 via the inlet pipe 30 is flowed to the second header tank 20 through the tube 61 of the first row, a second region A2 which is adjacent to the first region A1 and in which the refrigerant flowed to the second header tank 20 through the first region A1 is flowed to the first header tank 10 through the tube 61 of the first row, a third region A3 which is adjacent to the second region A2 and in which the refrigerant flowed to the first header tank 10 through the second region A2 is flowed to the second header tank 20 through the tube 61 of the first row, and a fourth region A4 in which the refrigerant flowed through communication portion 70 of the second header tank 20 is flowed to the first header tank 10 through the tube 61 of the second row, a fifth region A5 which is adjacent to the fourth region A4 and in which the refrigerant flowed to the first header tank 10 through the fourth region A4 is flowed to the second header tank 20 through the tube 61 of the second row, and a sixth region A6 which is adjacent to the fifth region A5 and in which the refrigerant flowed to the second header tank 20 through the fifth region A5 is flowed to the first header tank 10 through the tube 61 of the second row. Then, the refrigerant is discharged through the outlet pipe 40.

In this situation, as shown in FIG. 18, the communication portion 70 including the communicating hole 71 is formed at one side (the right side of the drawing) of the second header tank 20 so as to communicate the third and fourth regions A3 and A4, and the surface area A70 of the communication portion 70, which is designated by oblique lines in the second header tank 20 including the surface area A71 of the communicating hole 71, is the entire surface area in which the communicating hole 71 is formed.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

INDUSTRIAL APPLICABILITY

According to the present invention, it is possible to provide a dimensional extent for maximizing the heat radiation amount, reducing the maximum temperature deviation of the core portion and allowing the refrigerant and air to be smoothly flowed, thereby maximizing the heat exchange efficiency.

The invention claimed is:

1. An evaporator comprising first and second header tanks which form two compartments and disposed in parallel to be apart from each other in a distance; inlet and outlet pipes which are respectively formed at one side of the first header tank; a baffle which is provided in each of the first header tank and the second header tank so as to control a flow of refrigerant and; a core portion having a plurality of tubes of which both ends are fixedly disposed at the first and second header tanks to form a first row communicating with the inlet pipe and a second row communicating with the outlet pipe, and a plurality of fins which are interposed between the tubes, wherein the core portion has a width Wcore of 20~35 mm, and a communication portion having a communicating hole for communicating parts of the first and second rows is formed in the second header tank, and an area of the communicating hole is formed to be 70~130% of a cross sectional area in the width direction of a compartment of the at least one or more compartments that is communicating with the first row communicating with the inlet pipe, wherein an area of the communicating hole is formed to be 15~30% of a surface area of the communication portion partitioned by the baffle of the second header tank, and wherein the evaporator comprises:

a first region in which the refrigerant introduced to the first header tank via the inlet pipe is flowed to the second header tank through a first subset of the tubes of the first row;

a second region adjacent to the first region in which the refrigerant flowed to the second header tank through the first region is flowed to the first header tank through a second subset of the tubes of the first row;

a third region adjacent to the second region in which the refrigerant flowed to the first header tank through the second region is flowed to the second header tank through a third subset of the tubes of the first row;

a fourth region in which the refrigerant flowed through the communication portion formed in the second header tank is flowed to the first header tank through a first subset of the tubes of the second row;

a fifth region adjacent to the fourth region in which the refrigerant flowed to the first header tank through the fourth region is flowed to the second header tank through a second subset of the tubes of the second row; and a sixth region adjacent to the fifth region in which the refrigerant flowed to the second header tank through the fifth region is flowed to the first header tank through a third subset of the tubes of the second row, and the refrigerant is discharged through the outlet pipe.

2. The evaporator as set forth in claim 1, wherein the communication portion has one communicating hole.

3. The evaporator as set forth in claim 1, wherein each of the plurality of fins has a height Hfin of 4~7 mm.

4. The evaporator as set forth in claim 3, wherein each of the plurality of tubes has a height Htube of 2~3 mm.

5. An evaporator comprising first and second header tanks which form two compartments and disposed in parallel to be apart from each other in a distance; inlet and outlet pipes which are respectively formed at one side of the first header tank; a baffle which is provided in each of the first header tank and the second header tank so as to control a flow of refrigerant and; a core portion having a plurality of tubes of which both ends are fixedly disposed at the first and second header tanks to form a first row communicating with the inlet pipe and a second row communicating with the outlet pipe, and a plurality of fins which are interposed between the tubes, wherein the core portion has a width Wcore of 20~35mm, and a surface area of each tube of the plurality of tubes in the core portion is formed to be 30~50 % of a surface area of each fin of the plurality of fins, and a communication portion having a communicating hole for communicating parts of the first and second rows is formed in the second header tank, wherein an area of the communicating hole is formed to be 15~30 % of a surface area of the communication portion partitioned by the baffle of the second header tank, and wherein the evaporator comprises:

a first region in which the refrigerant introduced to the first header tank via the inlet pipe is flowed to the second header tank through a first subset of the tubes of the first row;

a second region adjacent to the first region in which the refrigerant flowed to the second header tank through the first region is flowed to the first header tank through a second subset of the tubes of the first row;

a third region adjacent to the second region in which the refrigerant flowed to the first header tank through the second region is flowed to the second header tank through a third subset of the tubes of the first row;

a fourth region in which the refrigerant flowed through the communication portion formed in the second header tank is flowed to the first header tank through a first subset of the tubes of the second row;

a fifth region adjacent to the fourth region in which the refrigerant flowed to the first header tank through the fourth region is flowed to the second header tank through a second subset of the tubes of the second row; and a sixth region adjacent to the fifth region in which the refrigerant flowed to the second header tank through the fifth region is flowed to the first header tank through a third subset of the tubes of the second row, and the refrigerant is discharged through the outlet pipe.

6. The evaporator as set forth in claim 5, wherein an area of the communicating hole is formed to be 70~130 % of a cross sectional area in the width direction of the compartment of the at least one or more compartments that is communicating with the first row communicating with the inlet pipe.

7. The evaporator as set forth in claim 5, wherein a density Dfin of the fins is 60~78 FPDM (Fin Per Deci-Meter).

* * * * *